United States Patent [19]

Cassidy

[11] Patent Number: 4,671,453

[45] Date of Patent: Jun. 9, 1987

[54] TAMPER-PROOF SLEEVE

[75] Inventor: Benjamin J. Cassidy, Waldwick, N.J.

[73] Assignee: International Paper Company, New York, N.Y.

[21] Appl. No.: 907,951

[22] Filed: Sep. 12, 1986

[51] Int. Cl.[4] ..... B65D 5/04

[52] U.S. Cl. ..... 229/40; 206/147; 206/807; 206/434; 229/102

[58] Field of Search ..... 229/40, 102, 87 R; 206/807, 140, 147, 429, 430, 434, 435

[56] References Cited

U.S. PATENT DOCUMENTS

| | | | |
|---|---|---|---|
| 2,274,253 | 2/1942 | Howell | 206/44 |
| 2,738,055 | 3/1956 | Shanahan | 206/45.14 |
| 2,881,914 | 4/1959 | Woeber et al. | 229/40 |
| 2,904,170 | 9/1959 | Hennessey et al. | 229/40 |
| 3,080,050 | 3/1963 | Fielding | 206/65 |
| 3,347,366 | 10/1967 | De Paul | 229/40 |
| 3,411,696 | 11/1968 | Ayer et al. | 229/40 |
| 3,443,681 | 5/1969 | Wysocki | 229/40 |
| 3,482,678 | 12/1969 | Mason | 206/45.14 |
| 3,604,560 | 12/1971 | Farquhar | 206/46 FD |
| 3,604,614 | 12/1971 | Sternfeld | 229/40 |
| 3,618,844 | 11/1971 | Pawlowski | 229/39 R |
| 3,618,848 | 11/1971 | Pawlowski et al. | 229/40 |
| 3,642,125 | 2/1972 | Johnson | 206/47 R |
| 3,666,089 | 5/1972 | Souza | 206/52 W |
| 3,765,529 | 10/1973 | Mueller | 206/45.14 |
| 3,819,035 | 6/1974 | Jaeschke | 206/45.14 |
| 4,037,721 | 7/1977 | Schillinger | 206/434 |
| 4,130,202 | 12/1978 | Champlin et al. | 229/40 |
| 4,164,286 | 8/1979 | Sutherland | 206/434 |
| 4,197,941 | 4/1980 | Halasz | 229/40 |
| 4,416,411 | 11/1983 | Desmond et al. | 229/40 |
| 4,489,880 | 12/1984 | Calvert | 229/40 |
| 4,596,356 | 6/1986 | Chaussadas | 229/40 |

*Primary Examiner*—Stephen Marcus
*Assistant Examiner*—Gary E. Elkins
*Attorney, Agent, or Firm*—W. T. Zielinski

[57] ABSTRACT

A one piece blank which may be erected into a tamper evident sleeve for housing a container. The sleeve blank includes hingedly connected top, side, base and attachment panels. The tamper-proof feature of the invention is provided by a retention panel which is pivotally connected to the attachment panel and projects into the interior of the sleeve. The retention panel includes spaced leg projections which are dimensioned to conform and frictionally engage the container in locking orientation.

7 Claims, 4 Drawing Figures

FIG. 2
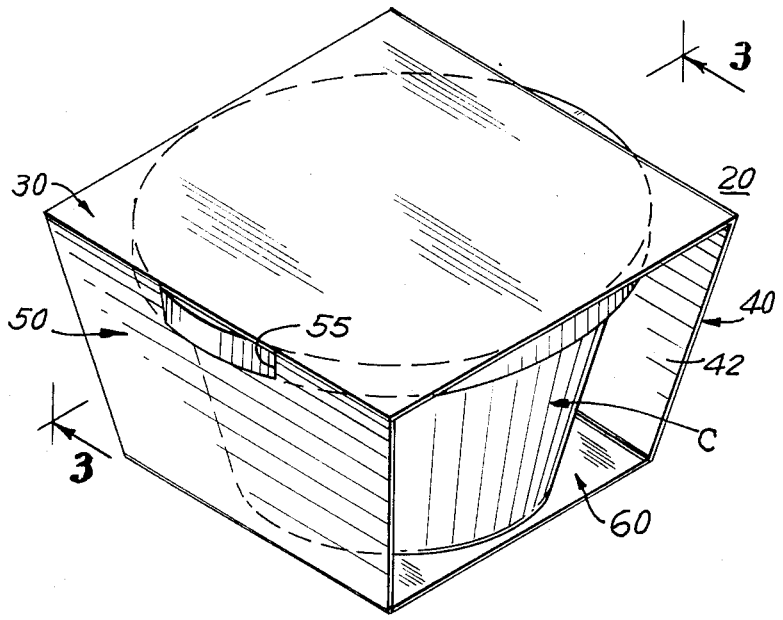
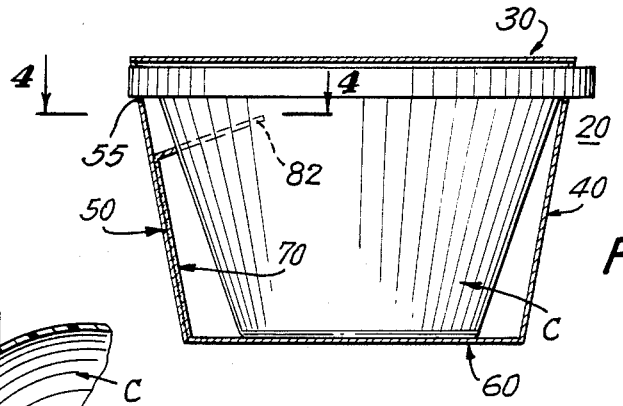
FIG. 3
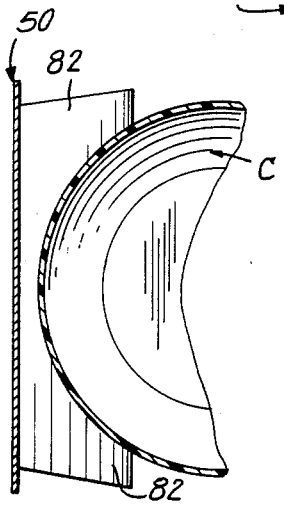
FIG. 4

TAMPER-PROOF SLEEVE

FIELD OF INVENTION

This invention generally relates to a carton wrapper for tapered food containers and, more particularly a sleeve which incorporates a contoured retention member which provides a tamper-proof feature.

BACKGROUND ART

Tapered plastic containers with snap on or screw on closures have become increasingly popular for packaging food products, particularly fresh fruit, salad and dairy products. Such containers provide economies in packaging and convenience to the consumer in use, reclosure and storage. Containers of this type which are often provided with decorative designs have typically been offered to the consumer in open ended enclosing sleeves which facilitate display and stacking of product in supermarkets. Sleeve packages also provide space for brand names and product information.

Sleeves presently finding wide application have a generally rectangular or trapezoidal configuration and are dimensioned to frictionally receive housed containers. In order to prevent dislodgement of the containers slots or notches are typically provided in opposing side walls of the sleeve to engage the container closure lid which includes a peripheral edge or flange projecting outward from the container body. Engagement of the closure within such retention slots secures the container in the sleeve.

It has been recognized in the art, however, that frictional retention sleeve arrangements are not entirely satisfactory in guarding against tampering of food products. Difficulty has been presented by the relative ease with which the consumer may remove and replace containers with more expensive products without damage to the sleeve or evidence of tampering. It will be appreciated that a tamper-proof feature is also important for assuring product integrity and safety.

The packaging industry has proposed various sleeve retention structures which have not proved to be commercially satisfactory. An early approach is exemplified by U.S. Pat. No. 2,274,253 to Howell which is directed to an open ended sleeve which slidably receives a container. The sleeve includes a front wall having hingedly attached opposing wings which pivot about crease lines and are received within the open ends of the sleeve. Each wing has a curved edge which respectively engage an annular indentation in opposing sides of the cover to secure the container within the sleeve. This structure is not effective in that the retention wings may be readily disengaged by the consumer and again fastened in place without revealing evidence of tampering.

Another approach of the prior art is disclosed in U.S. Pat. No. 3,604,560 to Farquhar which shows an open ended sleeve which includes extension flaps extending from end edges of a bottom wall. Each extension flap includes a plurality of fold lines which define an end stop for the enclosed container, and a locking tab arrangement to secure the stop and evidence tampering. Fundamentally, difficulty is presented by the complex pattern of score lines and folding operations required to construct the sleeve with associated machining and packaging costs. Specifically, each extension flap includes a score pattern which requires bifolding of panel sections to define the stop which includes a locking tab, and arcuate legs for conforming engagement with a container. Following this folding operation the container is placed within the sleeve and the bifolded extension flap is pivoted into vertical orientation with respect to the open end of sleeve to engage the locking tab with a corresponding tongue to define a closure. Machining accuracy and costs are associated with the performance of required folding and locking operations in proper sequence.

Other approaches of the prior art are similarly characterized by complex folding structures which have not proved to be entirely satisfactory. Such further approaches of the art are represented by the following U.S. Pat. Nos. 2,738,055 to Shanahan; 3,618,848 to Pawlowski; 3,765,529 to Mueller; and 4,416,411 to Desmond.

The present invention is directed to a sleeve construction having a retention structure of uncomplex design which is compatible with conventional packaging machinery and provides enhanced effectiveness over prior art arrangements. It will be appreciated that an effective retention structure which does not require extensive retooling of conventional sleeve machinery will effect cost savings and a meet a need of the packaging art.

Accordingly, it is a broad object of the present invention to provide an improved sleeve of uncomplex design which incorporates a tamper-proof retention feature.

A more specific object of the invention is provide a sleeve construction including a retention and tamper-proof structure which is cost effective in material and compatible with conventional sleeve forming machinery.

DISCLOSURE OF THE INVENTION

In the present invention, these purposes, as well as others which will be apparent, are achieved generally by providing a blank which may be erected into a tamper-proof sleeve for housing a container. The sleeve blank includes a top panel having first and second scored edges, first and second side panels which are hingedly connected to the scored edges, and a base panel hingedly attached to a first scored base edge of the first side wall. The blank also includes an attachment panel which is hingedly connected to a second scored base edge in the base and attached to an interior surface of the second side panel.

A tamper-proof feature in the invention is provided by a retention panel which is pivotally connected to the attachment panel and projects into the interior of the sleeve. The retention panel includes spaced leg projections which are dimensioned to conform and frictionally engage the container in locking orientation. During packaging, the blank is wrapped around the container, the retention member is positioned in engagement with the container, and the attachment panel is secured to the side wall to form the sleeve. The locking arrangement of the retention panel requires distortion or severance of the leg projections to release the container from the sleeve.

In a preferred embodiment of the invention, particularly suitable for containers having an inwardly tapered circular contour cover with projecting peripheral edge, the leg projections have an arcuate configuration and engage the container in an angular retention plane which is angularly offset above a generally horizontal base plane of the sleeve. This orientation prevents downward pivoting of the leg projections for release of the container. In this embodiment, the leg projections are also provided with sufficient arcuate lengths, such that their upward pivotal movement is obstructed by the top panel in the sleeve. Further advantage is obtained by providing slots in the side walls for receiving the projecting peripheral edge of the container cover.

Other objects, features and advantages of the present invention will be apparent when the detailed description of the preferred embodiment of the invention is considered in conjunction with the drawings, which should be construed in an illustrative and not limiting sense, as follows:

BRIEF DESCRIPTION OF THE DRAWINGS

FIG. 2 is a perspective view of a sleeve formed from the blank of FIG. 1 housing a container;

FIG. 3 is a vertical cross-sectional view of the sleeve taken along the line 3—3 of FIG. 2; and FIG. 4. is a horizontal cross-sectional view of the sleeve taken along the line 4—4 of FIG. 3.

BEST MODE OF CARRYING OUT THE INVENTION

Figure 1:
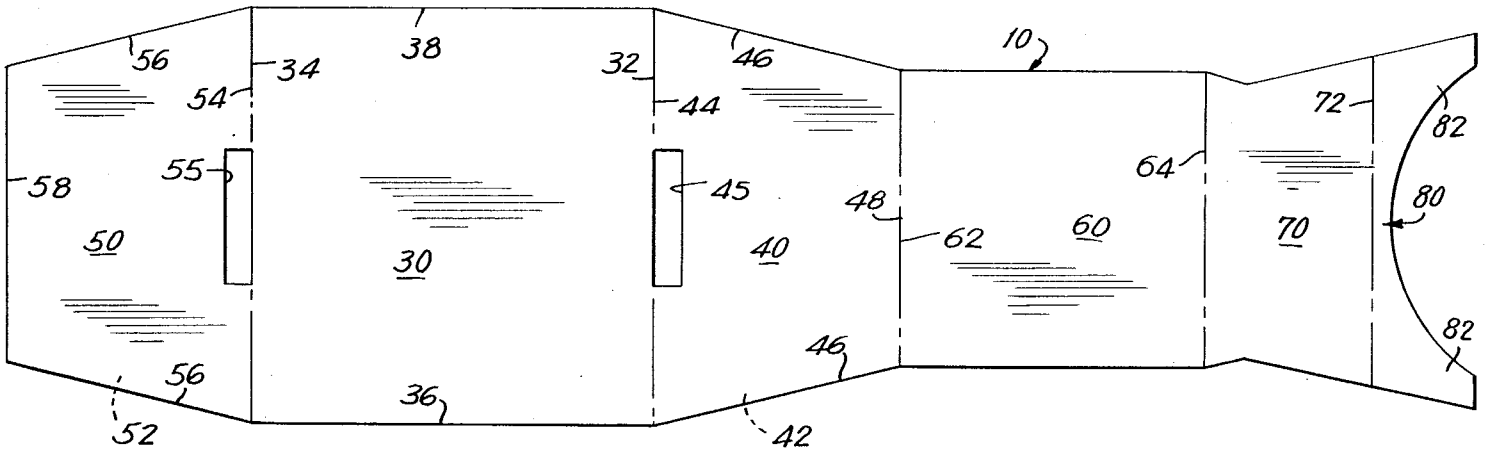
FIG. 1 shows a plan view of a blank cut and scored to form the sleeve of the present invention.

Referring now to the drawings, a blank and a tamper-proof sleeve formed from blank, respectively designated 10, 20, are illustrated in FIGS. 1–4. The sleeve 20 is preferably dimensioned to frictionally receive a container C having an inwardly tapered circular configuration.

The container which may be fabricated of conventional materials, for example, plastic or paperboard, preferably includes a cover having a peripheral edge which extends outwardly relative to the container boundary wall. Although the sleeve has application for housing general purpose containers, it is particularly suitable for food packaging.

The blank 10 comprises a top panel 30, first and second side panels 40, 50, a base panel 60, an attachment panel 70, and retention panel 80. For food applications, the sleeve blank is preferably fabricated of conventional folding carton paperboard in the 14 to 22 pt. range.

Top panel 30 which forms a top end in the erected sleeve includes first and second opposing scored edges 32, 34, and connecting side edges 36, 38.

First and second side panels 40, 50 are hingedly connected to the first and second scored edges 32, 34, to form generally opposing side walls in the erected sleeve, as shown in FIG. 2. Each side panel includes interior and exterior surfaces 42, 52, a top edge 44, 54, lateral edges 46, 56, and bottom edge 48, 58. To accommodate the inwardly tapered design of the container, the lateral edges 46, 56 of the side walls may taper or angle inwardly from the first and second scored edges 32, 34 to the base panel 60. As will be described hereinafter, the side walls 40, 50 may also include slots 45, 55 disposed adjacent top edges 44, 54 for receiving the peripheral extending edge of the container cover.

Base panel 60 which is hingedly attached to the first side panel 40 at a first base score line 62 formed on bottom edge 48, is oriented in generally opposing relation to the top end 30 to form the base of the sleeve. The base panel includes a second scored base edge 64 which is spaced from and generally oriented in parallel relation to the first scored edge 62. Again, for purposes of accommodating the container configuration, the top end 30 of the container is preferably wider than base 60.

Attachment panel 70 is hingedly connected to the second scored base edge 64 for attachment to the interior surface 52 of the second side panel 50 and formation of the sleeve 20, see FIG. 3. The attachment panel 70 includes a scored terminal edge 72 spaced from and oriented in parallel relation to the second base score line 64. It will be recognized that conventional adhesives may be employed to economically erect the sleeve.

FIGS. 3 and 4 illustrate the retention means employed in the invention for locking the container in the sleeve. The retention means includes retention panel 80 which is hingedly attached to the terminal attachment panel edge 72. As best shown in FIG. 4, the retention panel 80 includes spaced projecting legs 82 which conform to and frictionally engage the boundary wall of the housed container. A tamper-proof feature is provided by dimensioning the retention panel 80 so that it must be distorted or severed to release the container from the sleeve.

In the preferred embodiment of the invention, the leg projections 82 have an arcuate configuration and engage the container boundary wall in a retention plane which is angularly offset above the horizontal plane of the base panel 60 in the erected sleeve. This orientation prevents downward pivoting of the leg projections 82 and release of the container.

As best shown in FIG. 3, the leg projections 82 are also provided with sufficient lengths so that they may not be upwardly pivoted to overlie the side wall 50 and release the container. Such pivotal movement of the leg projections is obstructed by the top end 30 of the sleeve and container cover.

From the foregoing it will be appreciated that the retention panel 80 which must be distorted or severed in order to release the container from the sleeve providing evidence of tampering and the tamper-proof feature of the invention. Advantageously, the retention panel 80 coacts with the side panel slots 45, 55 to effect a secure engagement of the container within the sleeve.

In practice the sleeve 20 is provided to the packaging industry in the form of a blank, as shown in FIG. 1. The blank 10 is wrapped around the container C with conventional sleeve packaging machinery modified to accommodate the provision of retention panel 80. During the wrapping of the sleeve the retention panel is locked in frictional engagement with the container to provide the tamper-proof sleeve of the invention. It will be appreciated that packaging economies are effected by the invention by permitting use of conventional sleeve machinery without requirement of extensive retooling.

Thus, the objectives of the invention are accomplished by provision of a retention panel 80 which locks the container in the sleeve and provides observable evidence of package tampering. In a departure from the prior art, the sleeve 20 provides tamper-proof features in a sleeve of uncomplex design which effects packaging efficiencies.

Numerous modifications are possible in light of the above disclosure. For example, the drawings show a sleeve which is designed to house an inwardly tapered circular container. It will be appreciated that the sleeve and retention panel configuration may be modified to accommodate containers having other configurations. In similar manner, although the sleeve is preferably fabricated of paperboard, other conventional packaging materials may also be employed in the sleeve.

It is to be understood, therefore, that the above-described embodiments are merely illustrative, and other embodiments may be devised by those skilled in the art, without departing from the spirit or scope of the present invention, as set forth in the appended claims.

I claim:

1. A blank for forming an open ended sleeve, said sleeve having an interior compartment dimensioned to receive a container, the container including upper and lower ends and a circular boundary wall which tapers inwardly between the upper and lower ends, said blank comprising:

a top panel which forms a top end in the sleeve, said top panel including first and second generally opposing edges each bordered by first and second score lines;

first and second side panels respectively hingedly connected to said first and second scored edges, said side panels having interior and exterior surfaces, top edges, lateral edges, and bottom edges, said first side panel including a first base score line formed on said bottom edge which is generally parallel to said first score line, said side walls being oriented in generally opposing relation to form side walls in the sleeve;

a base panel hingedly attached to said first base score line and oriented in generally opposing relation to said top panel to form a base in the sleeve, said base panel including a second base score line spaced from and oriented in generally parallel relation to said first base score line;

an attachment panel hingedly connected to said second base score line, said attachment panel including a scored terminal edge spaced from and oriented in parallel relation to said second base score line, said attachment panel overlying and being secured to the interior surface of said second side panel to form the sleeve; and retention means for locking the container in the sleeve, said retention means including a retention panel which is hingedly connected to said scored terminal edge, said retention panel including spaced leg projections which are dimensioned to conform and frictionally engage the boundary wall of the housed container, said leg projections having arcuate surface configurations which engage the boundary wall in an upwardly oriented plane relative to said base, said leg projections having sufficient arcuate lengths with respect to the container, such that upward pivotal movement of said projections to overlying relation with respect to said second side wall is obstructed by said top panel, said retention panel providing a tamper-proof feature by requiring distortion or severance of said leg projections to release the container from the sleeve.

2. A blank for forming an open ended sleeve, said sleeve having an interior compartment dimensioned to receive a container, the container including upper and lower ends, a circular boundary wall which tapers inwardly between the upper and lower ends, and a cover having a peripheral edge which projects outwardly with respect to the boundary wall, said blank comprising:

a top panel which forms a top end in the sleeve, said top panel including first and second generally opposing edges each bordered by first and second score lines;

first and second side panels respectively hingedly connected to said first and second scored edges, said side panels having interior and exterior surfaces, top edges, lateral edges, botoom edges, and retention slots disposed adjacent said top edges for receiving the peripheral edge of the cover, said first said panel including a first base score line formed on said bottom edge which is generally parallel to said first score line, said side walls being oriented in generally opposing relation to form side walls in the sleeve;

a base panel hingedly attached to said first base score line and oriented in generally opposing relation to said top panel to form a base in the sleeve, said base panel including a second base score line spaced from and oriented in generally parallel relation to said first base score line;

an attachment panel hingedly connected to said second base score line, said attachment panel including a scored terminal edge spaced from and oriented in parallel relation to said second base score line, said attachment panel overlying and being secured to the interior surface of said second side panel to form the sleeve; and retention means for locking the container in the sleeve, said retention means including a retention panel which is hingedly connected to said scored terminal edge, said retention panel including spaced leg projections which are dimensioned to conform and frictionally engage the boundary wall of the housed container, said leg projections having arcuate surface configurations which engage the boundary wall in an angular retention plane upwardly offset relative to said base, said leg projections having sufficient arcuate lengths with respect to the container, such that upward pivotal movement of said projections to an overlying orientation with respect to said second side wall is obstructed by said cover and said top panel, said retention panel providing a tamper-proof feature by requiring distortion or severance of said leg projections to release the container from the sleeve.

3. A sleeve formed from a blank according to claim 2, wherein the sleeve has a trapezoidal configuration which conforms to the contour of the container.

4. A sleeve formed from a blank according to claim 3, wherein said lateral side edges of the side panels angle inwardly from said first and second scored edges to said base.

5. A sleeve formed from a blank according to claim 4, wherein said top end is wider than said base.

6. A blank for forming an open ended sleeve, said sleeve having an interior compartment dimensioned to receive a container, the container including upper and lower ends and a circular boundary wall which tapers inwardly between the upper and lower ends, said blank comprising:

a top panel which forms a top end in the sleeve, said top panel including first and second generally opposing edges each bordered by first and second score lines;

first and second side panels respectively hingedly connected to said first and second scored edges, said side panels having interior and exterior surfaces, top edges, lateral edges, and bottom edges, said first side panel including a first base score line formed on said bottom edge which is generally parallel to said first score line, said side walls being oriented in generally opposing relation to form side walls in the sleeve;

a base panel hingedly attached to said first base score line and oriented in generally opposing relation to said top panel to form a base in the sleeve, said base panel including a second base score line spaced from and oriented in generally parallel relation to said first base score line;

an attachment panel hingedly connected to said second base score line, said attachment panel including a scored terminal edge spaced from and oriented in parallel relation to said second base score line, said attachment panel overlying and being secured to the interior surface of said second side panel to form the sleeve; and a retention panel which is hingedly connected to said scored terminal edge, said retention panel including spaced leg projections which are dimensioned to conform and frictionally engage the boundary wall of the housed container, said leg projections engaging said boundary wall in an angular retention plane which is upwardly offset relative to said base, said leg projections having sufficient arcuate lengths with respect to the container, such that upward pivotal movement of said projections to overlying relation with respect to said second side wall is obstructed by said top panel, said retention panel providing a tamper-proof feature by requiring distortion or severance of said leg projections to release the container from the sleeve.

7. The blank of claim 6, wherein the container has a cover including a peripheral edge which projects outwardly with respect to the boundary wall, further comprising retention slots in the first and second panels disposed adjacent said top edges for receiving said peripheral cover edge.

* * * * *